US010119663B2

(12) United States Patent
Bayat et al.

(10) Patent No.: US 10,119,663 B2
(45) Date of Patent: Nov. 6, 2018

(54) DUAL-LIGHT FLASHLIGHT WITH PIVOTING BEAM HOUSING

(71) Applicant: Bayco Products, Inc., Wylie, TX (US)

(72) Inventors: Bijan Bayat, Plano, TX (US); Aaron P. Shoulders, Sachse, TX (US)

(73) Assignee: Bayco Products, Inc., Wylie, TX (US)

( * ) Notice: Subject to any disclaimer, the term of this patent is extended or adjusted under 35 U.S.C. 154(b) by 0 days.

(21) Appl. No.: 15/479,667

(22) Filed: Apr. 5, 2017

(65) Prior Publication Data

US 2017/0292659 A1 Oct. 12, 2017

Related U.S. Application Data

(60) Provisional application No. 62/319,470, filed on Apr. 7, 2016.

(51) Int. Cl.

| | |
|---|---|
| ***F21L 4/04*** | (2006.01) |
| ***F21L 4/02*** | (2006.01) |
| ***F21V 23/04*** | (2006.01) |
| *F21Y 115/10* | (2016.01) |
| *F21V 21/088* | (2006.01) |

(52) U.S. Cl.

CPC ..... *F21L 4/045* (2013.01); *F21L 4/027* (2013.01); *F21V 23/0428* (2013.01); *F21V 21/0885* (2013.01); *F21Y 2115/10* (2016.08)

(58) Field of Classification Search

CPC ..... F21L 4/045; F21L 4/027; F21V 21/08; F21V 23/0428

USPC ..... 362/184

See application file for complete search history.

(56) References Cited

U.S. PATENT DOCUMENTS

| | | | | |
|---|---|---|---|---|
| 4,438,483 | A | 3/1984 | Gulliksen et al. | |
| 5,558,430 | A * | 9/1996 | Booty, Jr. | F21L 4/02 362/184 |
| 5,871,272 | A * | 2/1999 | Sharrah | F21L 4/025 362/184 |
| 5,971,562 | A * | 10/1999 | Yang | F21L 4/045 362/184 |
| 6,857,756 | B2 * | 2/2005 | Reiff | F21L 4/04 362/183 |
| 7,063,435 | B2 * | 6/2006 | Dallas | B25F 1/04 30/123 |
| D542,450 | S * | 5/2007 | Shiu | D26/39 |
| 7,731,385 | B2 * | 6/2010 | Spartano | H05B 35/00 362/184 |
| D676,992 | S | 2/2013 | Trude | |
| 8,575,893 | B2 | 11/2013 | Devaney et al. | |

(Continued)

FOREIGN PATENT DOCUMENTS

CN 1558137 A 12/2004

*Primary Examiner* — Bryon T Gyllstrom

(74) *Attorney, Agent, or Firm* — Whitaker Chalk Swindle & Schwartz PLLC; Stephen Mosher

(57) ABSTRACT

A battery operated illumination device having a pivoting head, with first and second independently controlled light sources. In a normal use orientation a spot light beam from a first light source is directed along a forward axis oriented at 90 degrees with a longitudinal axis of the device housing. A flood light beam from a second light source in the pivoting head is directed along an axis disposed between 30 and 60 degrees below the forward axis. In an alternate use orientation the pivoting head may be pivoted through up to 90° from the forward axis.

12 Claims, 4 Drawing Sheets

(56) References Cited

U.S. PATENT DOCUMENTS

| | | | | |
|---|---|---|---|---|
| 8,690,375 | B2 | 4/2014 | Bobbin et al. | |
| D712,080 | S | 8/2014 | Trude et al. | |
| 2002/0015296 | A1* | 2/2002 | Howell | E04B 9/006 362/11 |
| 2006/0028812 | A1* | 2/2006 | Yuen | F21L 4/02 362/184 |
| 2006/0044792 | A1* | 3/2006 | Dallas | G01J 3/10 362/184 |
| 2007/0014103 | A1* | 1/2007 | Teng | F21L 4/027 362/157 |
| 2010/0039801 | A1* | 2/2010 | Pelletier | F21L 2/00 362/184 |
| 2010/0046211 | A1* | 2/2010 | Spartano | F21L 4/027 362/157 |
| 2012/0033415 | A1* | 2/2012 | Sharrah | F21L 4/027 362/199 |

* cited by examiner

DUAL-LIGHT FLASHLIGHT WITH PIVOTING BEAM HOUSING

CROSS REFERENCE TO RELATED APPLICATIONS

The present application claims priority to U.S. Provisional Patent Application Ser. No. 62/319,470, filed Apr. 7, 2016, by the same inventors and entitled "Hands Free, Dual-Light Flash Light with Directed Flood Light Beam."

BACKGROUND OF THE INVENTION

1. Field of the Invention

The present invention generally relates to flashlight products and more particularly to hands-free lighting devices having at least two independent light emitting sources aimed at different angles from each other.

2. Background of the Invention and Description of the Prior Art

Users of flashlights, especially those engaged in public safety, police and fire protection, certain industrial occupations, and even some consumer applications, often have the need for a lighting device that enables hands-free operation. Several conventional products provide this feature but do so in a way that is cumbersome to use or directs light in a less than useful direction.

For example, hand held flashlight products have been available that include flood light beams directed downward at right angles to the axis of the flashlight main beam, wherein the typical use of the flashlight is to aim its flash light main beam straight ahead and the flood light beam, which is usually located on the underside of the body of the flashlight, is directed straight downward. This orientation of the flood light beam is adequate for illuminating the immediate area around the location of the user, if the user is standing or not in motion, but provides much less illumination ahead of a user that is walking through a dark area. Such beam orientation is of limited usefulness to security, public safety, and fire protection personnel who are often called upon to search dark and often hazardous areas for persons or property.

In the case of a helmet-mounted flashlight equipped with a downward-directed flood light, while it offers hands free use, there are at least two problems that arise because of the downward orientation of a flood light beam. One is that the light casts a shadow caused by the user's body. Another is that, for a user traversing a space, much of the useable light energy may be directed behind the user and is thus not of use forward of the user. Thus, much of the light energy is wasted, needlessly draining the battery.

Conventional, single-beam portable lighting devices exist that can be used hands-free such as by setting them down on the ground or attaching them to a user's clothing or headgear. Other portable lights position a single light source in a separate housing that pivots with respect to the lighting instrument. A deficiency of this design is that the beam of a single light source can only illuminate along its own axis, leaving other adjacent areas too dark to see into clearly.

Accordingly, there is a need for a portable, battery operated, hands free lighting device that has separate dual light beams and which provides for adjusting the beam axes of the light beams to accommodate the needs of the user to illuminate a wider region of space from the device.

SUMMARY OF THE INVENTION

Accordingly, a portable, battery operated flashlight having dual beams and a pivoting head is provided, comprising a body having a longitudinal axis and containing a battery power source and an ON-Off control circuit. A light source housing, pivotably attached to an upper portion of the body, includes first and second light sources. The light source housing is configured to pivot in a coplanar relationship with the longitudinal axis of the body such that the first and second light sources are oriented along respective first and second axes separated by a predetermined angle $\theta$.

In other aspects, the body includes a lower portion configured for supporting the body on a horizontal surface. The body also includes a support device for supporting the body on a user's clothing, body or belt. The support device may include spring clamp, a spring clip, a lanyard, a clip for receiving a belt, a ring for receiving a hook device, a keychain clip, and the like.

In another aspect, the first and second light sources are light emitting diodes (LEDs), one of which is configured to provide a spot light beam; and the other of the first and second light sources is configured to provide a flood light beam.

In another aspect, the light source housing is configured to pivot between a 0° alignment and a 90° alignment; wherein the 0° alignment is directed substantially at a right angle with respect to the longitudinal axis of the body, and the 90° alignment is directed upward from the 0° alignment.

In another aspect, the body and the light source housing may be configured with a detent disposed to secure the pivotable light source housing at selected angles such as 0°, 45°, or 90° with respect to the 0° alignment.

DETAILED DESCRIPTION OF THE INVENTION

Figure 1:
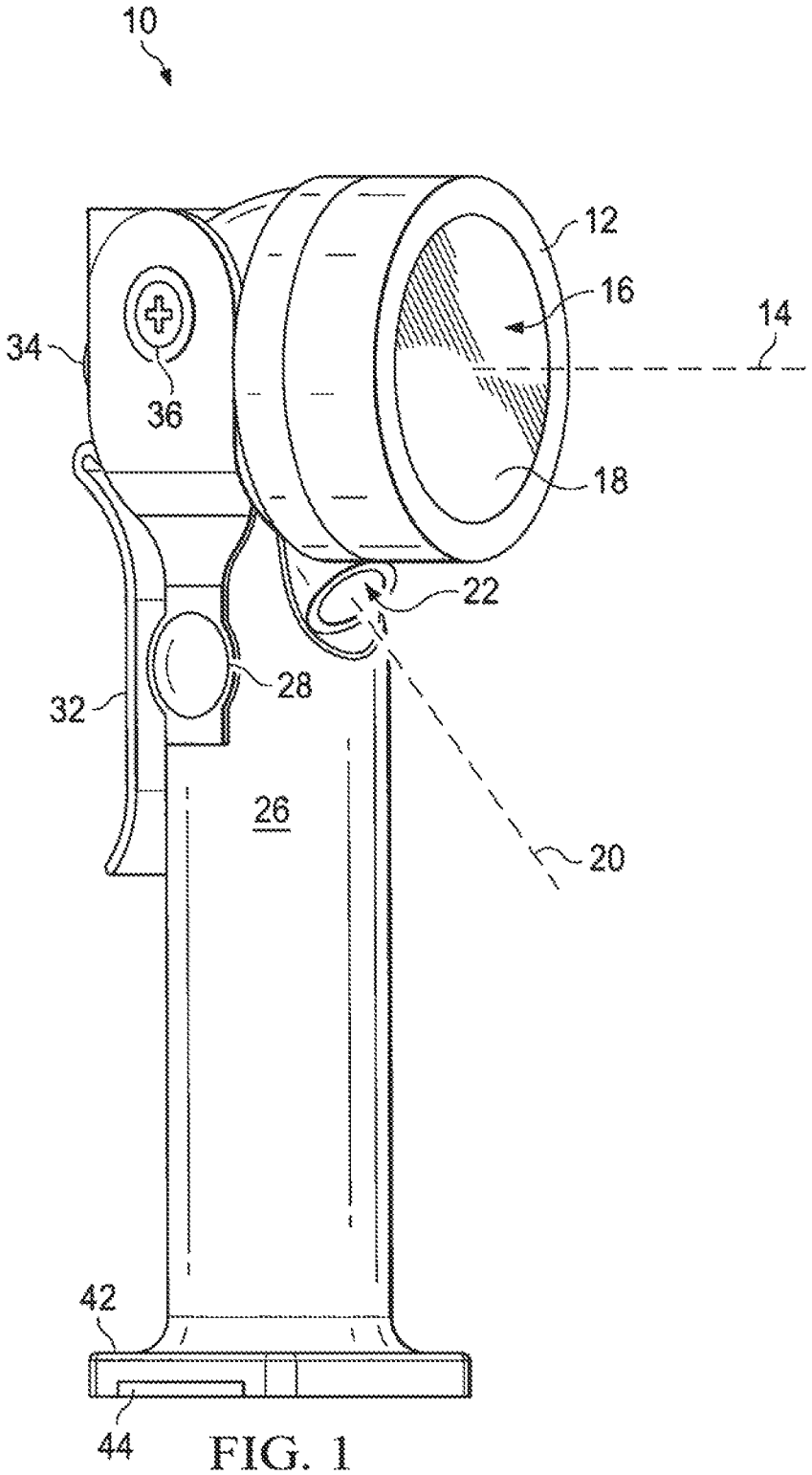
FIG. 1 illustrates an isometric view of one embodiment of a dual beam flashlight having a pivoting head according to the present invention.

In an advance in the state of the art, a dual beam flashlight with a pivoting beam head or housing is disclosed. The dual beam flashlight may preferably include a spot light beam and a flood light beam. The flashlight is configured for hands-free use and to be supported on a user's belt, or on the front of a user's garment or clothing at chest level, or even stood on a horizontal surface, to provide illumination with both hands free to carry equipment use tools or implements, carry or lead persons to safety, or to illuminate a space.

Examples of mechanisms for supporting the dual beam flashlight on a user's body garments may include but not be limited to a belt loop, a spring clip, a hook, a spring clamp, a lanyard, a hook-and-loop fastener, a metal ring, a keychain clip, and the like. Further, in most examples of the hands free, dual beam flashlight will preferably provide separate switching mechanisms for controlling the ON-OFF circuit of the first and second light beams.

During development of a product that embodies the concept of the present invention, it was been discovered that directing the axis of the flood light beam at an angle θ of approximately 45 degrees below a reference axis (defined as a datum or "0" degrees) that is straight ahead of the user and substantially parallel to the ground provides the optimum illumination of the ground ahead of the user regardless of how high off the ground the flood light beam source is above the ground level. Thus, the flood light beam may be aimed at a point on the ground ahead of the user where the 45 degree axis intersects the ground. This point is called the illumination target. This is a fortuitous result because the user does not have to adjust the beam angle or use a different lighting product to compensate for differences in the elevation of the spot light beam or the height of the user, etc.

The result of this orientation of the flood light beam is that the viewing angle (or, alternatively, emission angle or beam width, which is defined as the total angle where the beam intensity is 50% or more of the intensity "on-axis") can be adjusted to provide illumination directed toward the illumination target, with lesser but sufficient illumination directed off axis above, below, left and right of the flood light axis and the illumination target.

In the description that follows, reference numbers that appear in multiple figures of the drawings refer to the same structures. The figures depict and describe one illustrated embodiment of the concept of the invention and its uses. Persons skilled in the art will recognize variations in shape, proportions, dimensions, materials, choice of component parts and the like that may be assembled to provide an embodiment of the dual beam flashlight with a pivoting head described and claimed herein without departing from the concept as recited in the appended claims. For example, while deems that select angles of 0°, 45°, or 90° for the pivoting head are described for the exemplary embodiment, other angles, or even a continuous, friction-loaded pivot may be provided in certain applications. Reference herein to "the body 26" of the flashlight described herein includes a reference to its longitudinal axis that extends between the lower end of the body 26 configured as a base 42 and the upper end of the body 26 that supports the pivoting head 12.

FIG. 1 illustrates an isometric view of one embodiment of a dual beam flashlight. The dual beam flashlight 10 provides a spot light beam 14 and a flood light beam 20, respectively emitted by LED elements 16, 22. The flashlight 10 includes a pivoting head 12 that can be adjusted through an angle of up to 90° such that the pivoting head 12 is configured to pivot in a coplanar relationship with the longitudinal axis of the body 26. The body 26 of the flashlight 10 may enclose a battery power supply (not shown) and an ON-OFF control circuit. The external features of the body 26 include a lower end shaped as a base 42 to enable the flashlight 10 to be stood in an upright position on a surface that is flat and substantially horizontal. The base 42 may include a battery access door 44. An ON-OFF switch 28 for each beam may be positioned on either side of the body 26. In some embodiments, a single switch mechanism may be provided to control the ON-OFF function of both beams. In other embodiments a single switch for each beam may be provided.

A supporting mechanism such as a belt clip 32 and a loop attachment 34 for a lanyard as shown in the figures, or other mechanism may be provided to support the flashlight 10 on a user's clothing, body or belt. The pivot axis 36A that pivotably attaches the pivoting head 12 to the upper portion of the body 26 may preferably include a detent mechanism (not shown in this exterior view) to facilitate adjustment of the angle of the pivoting head 12 with the body 26. In the illustrated embodiment, the detests may be formed at angles of 0°, 45°, and 90°. A lock screw 36 may be provided on the pivot axis 36A of the pivoting head 12 to lock the head in a selected angle. The lock screw 36 may also function as a pivot axle that secures the pivoting head 12 in position in the body 26 structure of the dual beam flash light 10. Further, an embodiment may be configured to provide a pivot axis 36A that may include a friction mechanism or brake such as a clamp or resilient member (not visible in the figures) against the pivot axis 36A. Moreover, removal of the lock screw 36, for example, may facilitate disassembly of the pivoting head 12 for repairs or replacing the pivoting head itself.

The pivoting head 12 of the dual beam flashlight 10 preferably includes two light sources, preferably provided by light emitting diode (LED) emitters (not visible in this view). To provide the first light source—a spot light beam 14 in the illustrated example of the dual beam flashlight 10, the pivoting head 12 may include a conic section reflector 18 (e.g., parabolic, hyperbolic, etc.) typically behind a clear lens 18A (not visible in the figures) for directing a spot light beam 14 along the axis of the reflector 18. The spot light beam 14 may be emitted from one LED 16 or an array of LED emitters 16A positioned at the apex of the reflector 18. To provide the second light source—a flood light beam 20 in this example of the dual beam flashlight 10, a second LED emitter 22 is positioned on the underside of the pivoting head 12 and oriented at a fixed downward 45° angle with respect to the axis of the spot light beam 14. This second emitter 22 provides a flood light beam 20 for illuminating the path on the ground when the spot light beam 14 is directed horizontally. When the spot light beam 14 is oriented at an angle other than 0°, the orientation of the flood light beam 20 remains fixed at 45 relative to the spot light beam 14 to provide illumination of the space below the spotlight beam 14. This feature provides the illumination utility needed when inspecting areas above ground level or above the user's eye level using the spot light beam. For example, if the user needs to view details of an upper wall or ceiling and aims or adjusts the spot light beam 14 to view the intended target, the floodlight beam is well-positioned to illuminate the adjacent region below the spot light beam 14.

Figure 2:
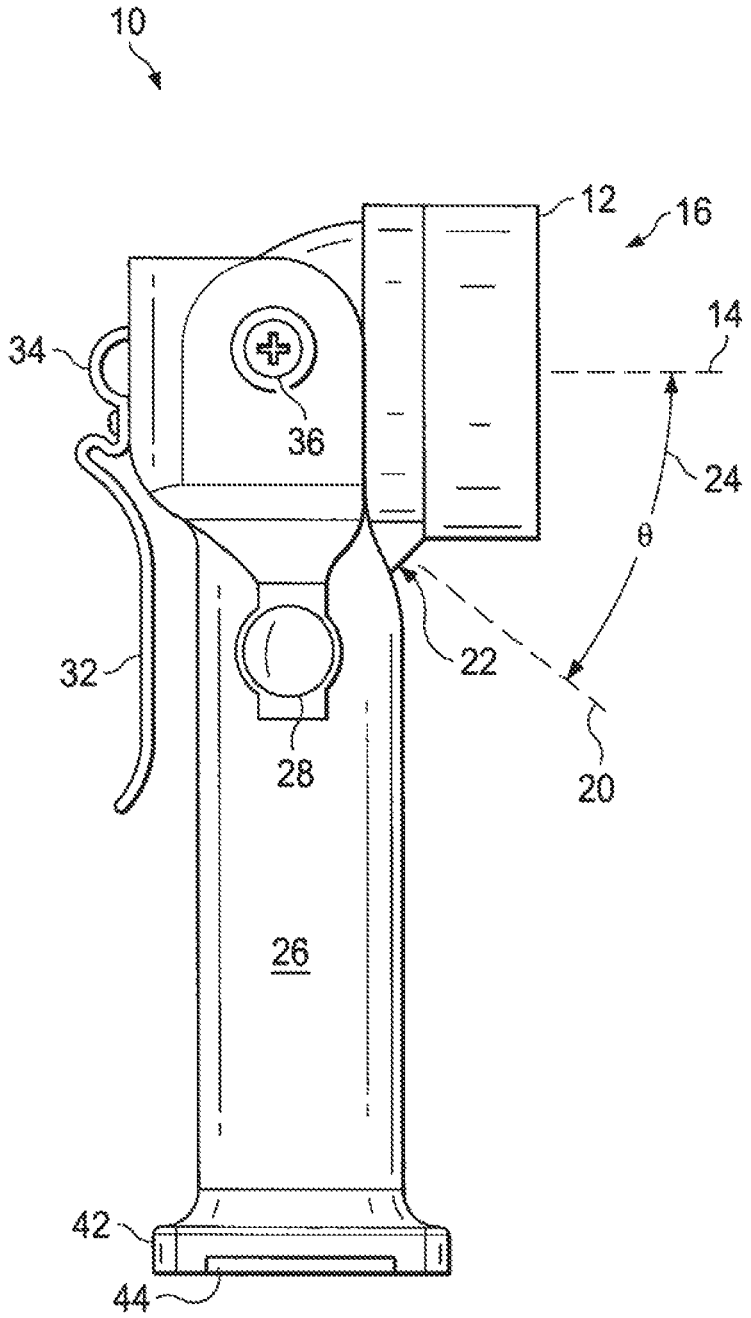
FIG. 2 illustrates a side elevation view of a dual beam flashlight according to the present invention with the pivoting head in a first orientation.

FIG. 2 illustrates a side elevation view of the dual beam flashlight 10 according to the present invention with the pivoting head 12 in a first orientation. In this view, the angle selected is 0°, which corresponds to directing the spot light beam 14 in a horizontal direction, at a right angle when the body 26 of the flashlight 10 is held in a vertical position. If the flood light 20 is switched ON, it is oriented toward the ground.

Figure 3:
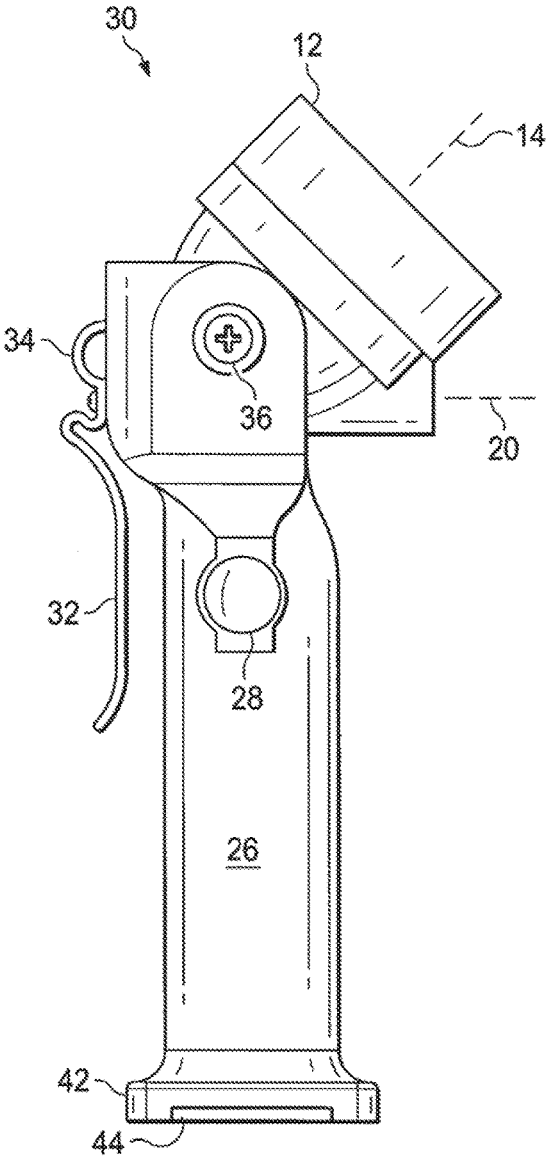
FIG. 3 illustrates a side elevation view of a dual beam flash according to the present invention with the pivoting head in a second orientation.

FIG. 3 illustrates a side elevation view of a dual beam flashlight 30 according to the present invention with the pivoting head 12 in a second orientation. In this view, the angle selected is 45°, which corresponds to directing the spot light beam 14 along an axis 45° to the body 26 of the dual beam flashlight 30 when it is held in a vertical position. If the flood light beam 20 is switched ON, it would be directed horizontally at the 45 angle relative to the axis of the spot light beam 14.

Figure 4:
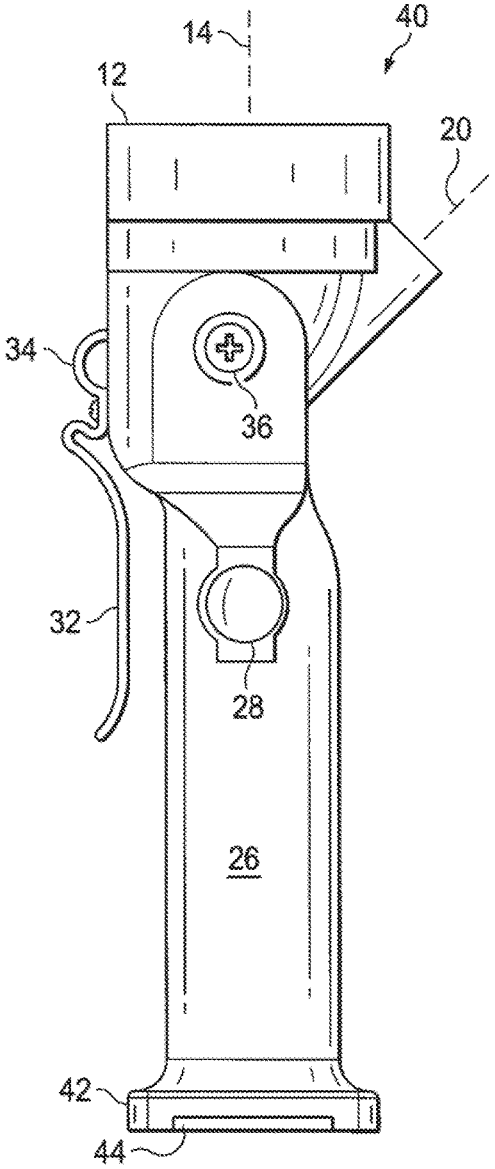
FIG. 4 illustrates a side elevation view of a dual beam flashlight according to the present invention with the pivoting, head in a third orientation.

FIG. 4 illustrates a side elevation view of a dual beam flashlight 40 according to the present invention with the pivoting head 12 in a third orientation, hi this view, the angle selected is 90°, which corresponds to directing the spot light beam 20 along the axis of the body 26 of the flash light 40, which directs the spot light beam 14 upward if the flashlight body 26 is positioned normal to the surface of the Earth or other horizontal surface. If the flood light beam 20 is switched ON, it would be directed upward at a 45° angle with a horizontal reference and 45° relative to the axis of the spot light beam 14.

Figure 5:
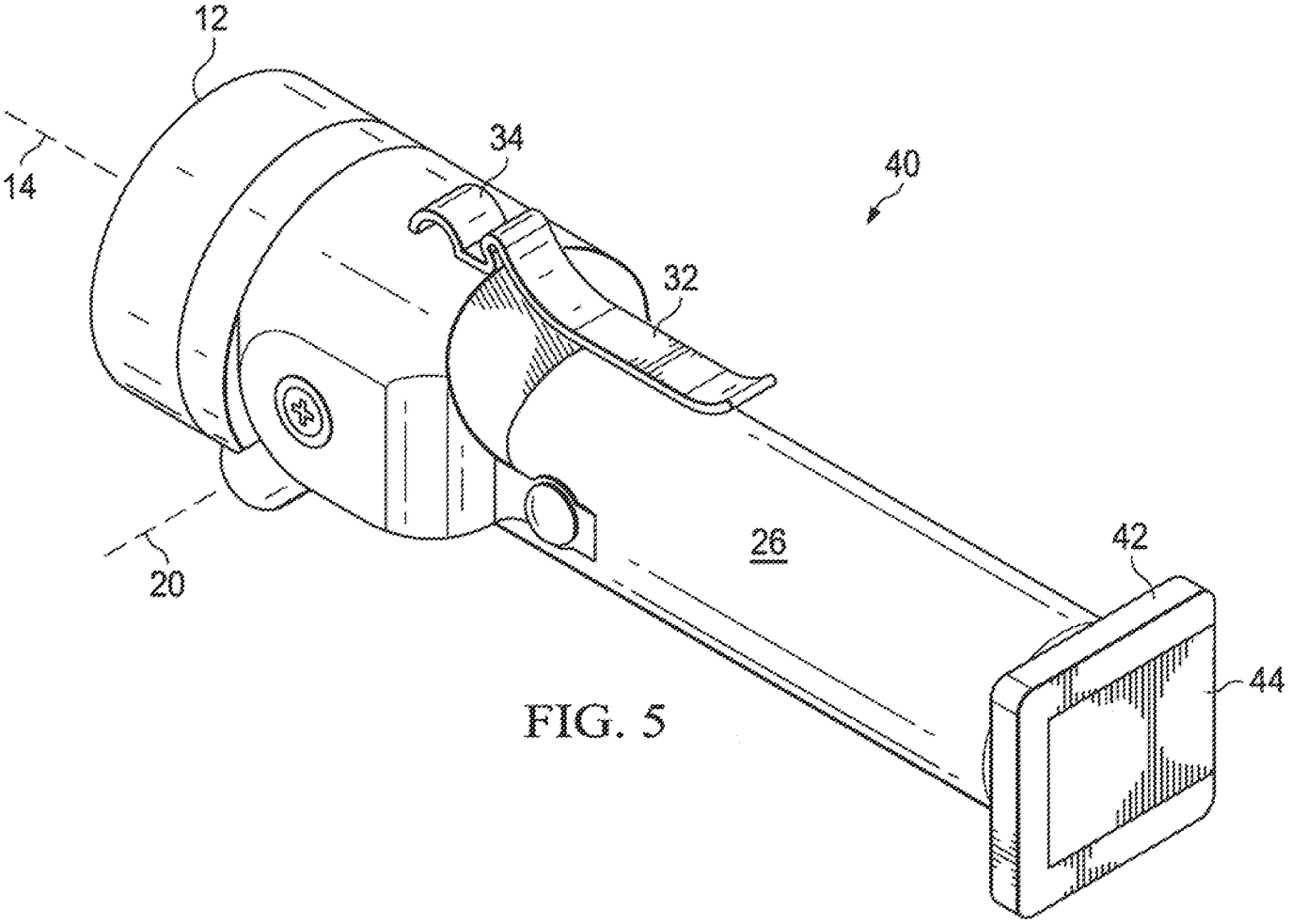
FIG. 5 illustrates a depiction of one alternative use of the dual beam flashlight depicted in FIGS. 1-4.

FIG. 5 illustrates a depiction of one alternative use of the dual beam flashlight 40 depicted in FIGS. 1-4. This alternative use is a special case of the embodiment of FIG. 4, which enables the dual beam flashlight 40 to be used like an ordinary flashlight as depicted in FIG. 5.

In an alternate embodiment to the illustrated embodiment of FIGS. 2, 3 and 4 depicting three fixed orientations of the light source head 12 that may be secured by a system of detents as described, a pivot axis 36A may be configured to include a friction mechanism or brake such as a clamp or resilient member (not visible in the figures) that restrains the motion of the light source head 12 as it is pivoted between the 0° and 90° orientations about the pivot axis 36A. In another aspect, removal of the lock screw 36 may facilitate disassembly of the pivoting head 12 for repairs or replacing the pivoting head itself.

The illustrated embodiment described herein is adapted to be carried by hand or used in a hands-free mode such as standing it on a surface, attaching it to a user's clothing, body or belt. The pivoting head 12 permits a variety of adaptations of the dual beams to the illumination needs of the user.

In FIGS. 2, 3, and 4, the angle between the axis of the first (e.g., spot light 14) and second (e.g., flood light 20) light beams may be designated as the angle θ, where, in these examples, θ=approximately 45°. As noted herein above the angle θ=45° provides an optimum light pattern for a user in motion because it spreads its light beam viewing angle (i.e., useable light emission angle within which the light intensity is 50% or greater where the intensity along the zero degree axis is typically at a maximum.

The angle θ, while preferably should be approximately 45° in this example, may be adjusted in particular products to other values. Selection of the 45° angle in most applications represents an optimum value because the illumination pattern remains the same regardless of the height of the light emitting sources above the Earth, and because it generally provides the best overall illumination of hazards in the path of the user. Thus a five foot tall user wearing a hands free lamp as in FIG. 2 would experience the same general illumination pattern as a six foot tall user. This is a consequence of the Tangent of the angle 45° being equal to 1.00. The 45° angle also tends to maintain the flood light beam downward and away from an oncoming person's vision.

It is, of course possible to select angles between 40° and 50°, or 35 and 55°. However, even angles up to 15° away from 45° may be used to advantage. The value chosen may depend on the emission angles of the particular light emitting sources, the type of lens 18A that may be used with the emitter 16 and its reflector 18, etc. as well as the type of uses that are anticipated for a particular product. Broadly stated, the angle θ, while preferably approximately 45° or within, e.g., up to +/−fifteen degrees of 45°, may generally be defined by 30°<θ<60°. In one alternative, an angle that varies from 45° more than a nominal amount, say +/−10 degrees may employ a custom made reflector to provide appropriate control of the beam width and pattern.

In another alternative, selection of the angle θ may depend on the intensity of the light output of the particular emitter. For example, higher intensity output as measured in Lumens may favor selection of the lesser angles, between 30 and 40 degrees, while lower intensity outputs may be more suited to the greater angles between 50 and 60 degrees. These ranges are based on consideration of the light pattern on the ground ahead of the user. Thus, the stronger light outputs provide more light at the greater distances from the user when the angle θ is lesser than the 45° nominal preferred value.

The body of the flashlight may be equipped with mechanisms to support the flashlight on a user's body, garments or belt to enable hands-free uses. The pivoting head pivots through an angle of approximately 90 degrees and may be easily set to either of three angles, 0°, 45°, or 90° by detents incorporated into the pivot axis of the pivoting head. Other detent angles may be provided, or the head may include a friction pivot to hold the pivoting head in any angle between the 0° and 90° references. Of course, other reference angles besides the 0° and 90° references may be designed into the dual beam flashlight disclosed herein. Moreover, various kinds of light sources, reflectors, lenses, etc. may be incorporated into the pivoting head of the flashlight. The dual beam flashlight may include other additional features without departing from the basic concept set forth in the appended claims.

While the invention has been shown in only one of its forms, it is not thus limited but is susceptible to various changes and modifications without departing from the spirit thereof. In basic concept the invention comprises the combination, in a portable, battery operated flashlight, of a body containing a battery power source and an ON-Off control circuit, which includes a pivoting head attached to an upper portion of the body that includes first and second light independent sources for producing separate light beams, wherein the first and second light beams are oriented along respective first and second axes separated by a predetermined angle θ so that as the pivoting head pivots in a plane coplanar with the longitudinal axis of the flashlight, the first and second light beams and their included angle θ pivot together. The first light beam is preferably a spotlight beam and the second light beam is preferably a flood light beam.

What is claimed is:

1. A portable, battery operated flashlight, comprising:

a body having a longitudinal axis and containing a battery power source and an ON-OFF control circuit wherein the body includes a hands-free support device for supporting the body on a user's clothing, body or belt; and a single light source housing pivotably attached to an upper portion of the body and including first and second light sources oriented along respective first and second axes separated by a predetermined angle θ substantially within the range of 30° to 60°;

wherein the single light source housing is configured to pivot in a coplanar relationship with respect to the longitudinal axis of the body between a first position aligned with a reference axis oriented at a right angle to the longitudinal axis and a second position directed along the longitudinal axis;

wherein a plurality of detents secures the pivotable light source housing at the first and second positions and a third intermediate position therebetween.

2. The flashlight of claim 1, wherein:

the body includes a lower portion configured for supporting the body on a horizontal surface.

3. The flashlight of claim 1, wherein:

the hands-free support device is selected from the group consisting of a spring clamp, a spring clip, a lanyard, a clip for receiving a belt, a ring for receiving a hook device, and a keychain clip.

4. The flashlight of claim 1, wherein the first and second light sources comprise:

independent light emitting diodes (LEDs); wherein one of the first and second light sources is configured to provide a spotlight beam; and the other of the first and second light sources is configured to provide a flood light beam.

5. The flashlight of claim 1, wherein:

the light source housing is configured to pivot between the first position along the reference axis and a 90° alignment thereto; and the 90° alignment defines the second position directed upward from the 0° alignment.

6. The flashlight of claim 5, wherein:

the body and the light source housing are configured with a plurality of detents disposed to secure the light source housing at the first and second positions and an intermediate third position therebetween.

7. The flashlight of claim 5, wherein:

the body and the light source housing are configured with a friction mechanism to secure the light source housing at any angle between the first and second positions.

8. The flashlight of claim 7, wherein the friction mechanism comprises:

a brake operable to exert a clamping tension upon a pivot axis between the light source housing and the body.

9. The flashlight of claim 1, wherein the predetermined angle θ is approximately 45°.

10. The flashlight of claim 1, wherein the battery power source comprises one or more batteries.

11. The flashlight of claim 1, wherein the ON-OFF circuit comprises:

a first switch operative to control the first light source; and a second switch operative to control the second light source.

12. The flashlight of claim 11, wherein:

the first and second switches are combined into a single switch mechanism.

* * * * *